US005192230A

United States Patent [19]

Gabany et al.

[11] Patent Number: 5,192,230

[45] Date of Patent: Mar. 9, 1993

[54] VERTICAL MOUNT CONNECTOR

[75] Inventors: Andrew J. Gabany, Mechanicsburg; James G. Dunbar, Lancaster, both of Pa.

[73] Assignee: AMP Incorporated, Harrisburg, Pa.

[21] Appl. No.: 885,101

[22] Filed: May 18, 1992

[51] Int. Cl.[5] ..... H01R 13/66

[52] U.S. Cl. ..... 439/620; 333/185

[58] Field of Search ..... 439/620; 333/181-185

[56] References Cited

U.S. PATENT DOCUMENTS 4,684,200 8/1987 Capp ..... 439/387
4,772,221 9/1988 Kozlof ..... 439/620
4,884,982 12/1989 Fleming et al. ..... 439/620
4,934,960 6/1990 Capp et al. ..... 439/620
5,062,811 11/1991 Hackman ..... 439/620

*Primary Examiner*—Gary F. Paumen

[57] ABSTRACT

An electrical connector 1 comprising: a conductive contact 6 connected to a circuit board mounting terminal 17, an insulative body 3 surrounding the contact 6, a conductive shell 2 surrounding the insulative body 3, a base 11 surrounding the shell 2, conductive circuit board mounting posts 13 on the base 11, the shell 2 being insulated from the base 11, and an electrical capacitor comprised of a dielectric element 26 between the shell 2 and the base 11.

14 Claims, 4 Drawing Sheets

13'
13
16
13
16
28
13'
22
11
1
2
6
24
26
25

VERTICAL MOUNT CONNECTOR

FIELD OF THE INVENTION

The invention relates to a connector that is vertically mounted to a circuit board and incorporates an electrical filter.

BACKGROUND OF THE INVENTION

A known connector described in U.S. Pat. No. 4,684,200, comprises, a conductive shell surrounding an insulative body, a conductive contact surrounded by the insulative body, a mounting terminal on the contact, a base surrounding the shell, and mounting posts projecting from the base. A mating portion of the shell projects from the base. The mating portion is for mated coupling with an electrical connector that is terminated to an electrical cable. The terminal and the mounting posts connect to a circuit board. The mounting posts connect the base of the connector to a conductive ground path of the circuit board. One of the drawbacks of the known connector is that radio frequency interference, RFI, can induce a voltage in a signal contact of the connector.

A connector described in U.S. Pat. No. 5,062,811, comprises, a conductive shell, capacitor elements against the shell, and a conductive clip engaging the capacitor elements and extending to mounting posts projecting from a housing surrounding the shell.

SUMMARY OF THE INVENTION

The invention is directed to an electrical connector constructed with an electrical capacitor suppressing RFI that could be transmitted from a signal contact of a connector to a circuit board. The capacitor is constructed with insulation material such as a dielectric element between a base of the connector and a conductive shell adapted with a mating portion for mating connection to another electrical connector. Voltages induced in the shell by RFI are transmitted through the capacitor to a ground plane or ground path on the circuit board to which the base is mounted.

According to the invention, a dielectric element is between the shell and a base of the connector.

According to an embodiment of the invention, an electrical connector comprises, a conductive contact connected to a mounting terminal, an insulative body surrounding the contact, a conductive shell surrounding the insulative body, a base surrounding the shell, a mating portion of the shell projecting from the base, conductive mounting posts on the base, and a dielectric element between the shell and the base.

The invention will now be described by way of example with reference to the drawings, according to which:

DETAILED DESCRIPTION

Figure 1:
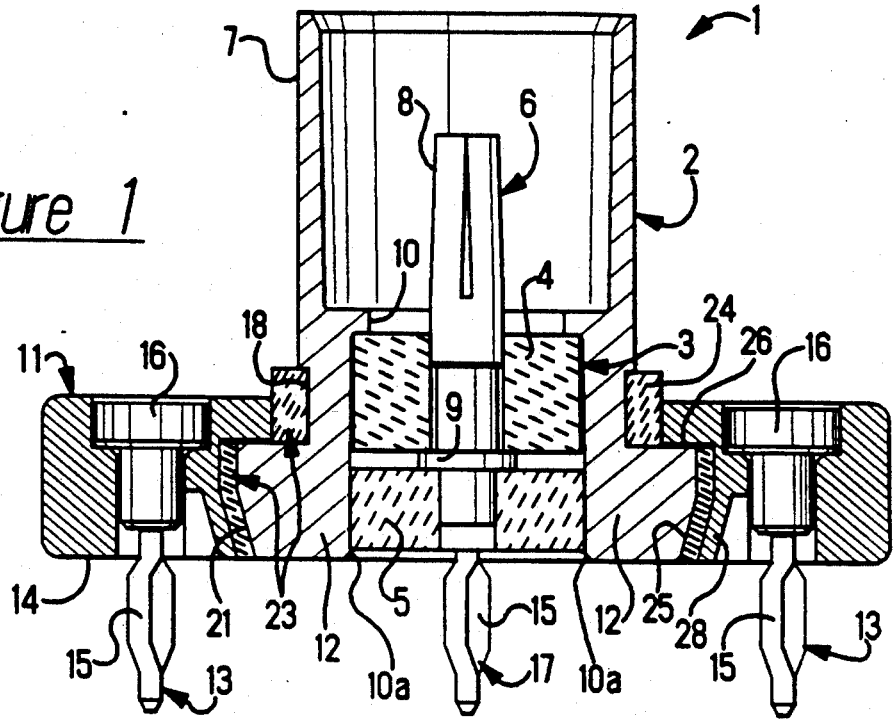
FIG. 1 is an elevation view in section of a connector comprising, a dielectric element between a shell and a base.

With reference to FIG. 1, a coaxial electrical connector 1 includes a hollow conductive shell 2 surrounding an insulative body 3, comprised of a first cylindrical portion 4 and a second cylindrical portion 5 surrounding a conductive electrical contact 6 concentric within the shell 2. The axis of the connector 1 is the concentric axis of the shell 2 and the contact 6. A top mating end 7 of the shell 2 provides a coupling for mated connection with another, complementary connector, not shown. An electrical receptacle portion 8 of the contact 6 is for mated connection with the complementary connector, not shown. The contact 6 has a radial flange 9 against which the portions 4, 5 of the insulative body 3 are seated. The shell 2 has an internal lip 10 against which the portion 4 seats to prevent movement of the insulative body 3 relative to the shell 2. A corner edge of the shell is indented inward radially at various points to provide protrusions 10*a* overlapping the portion 5 to prevent movement of the insulative body 3.

A broad base 11 surrounds a bottom 12 of the shell 2. The base 11 is conductive. Conductive, circuit board mounting posts 13 extend beyond a mounting surface 14 of the base 11 and are adapted with compliant portions 15 to be connected to a circuit board, not shown. The posts 13 are connected to the base 11 with enlarged heads 16. Other fasteners 13' mechanically mount the base 11 to the circuit board, not shown. A conductive, circuit board mounting, electrical terminal 17 of the contact 6 has a compliant portion 15 and extends beyond the mounting surface 14 to be connected to a circuit board, not shown. Further details of the connector 1 are described in U.S. Pat. No. 4,684,200.

Figure 2:
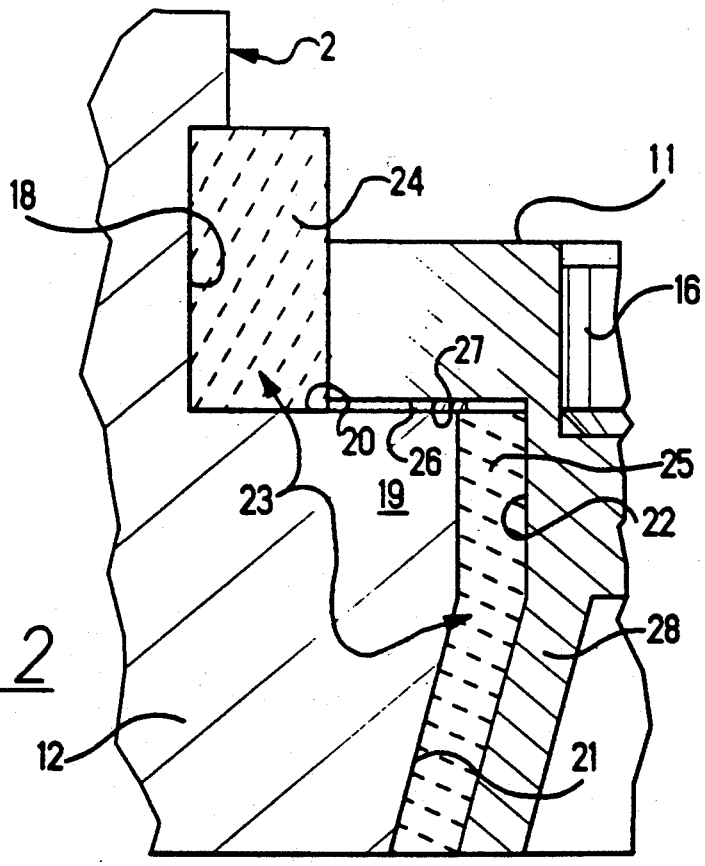
FIG. 2 is an enlarged fragmentary section view of a portion of the connector shown in FIG. 1.
Figure 3:
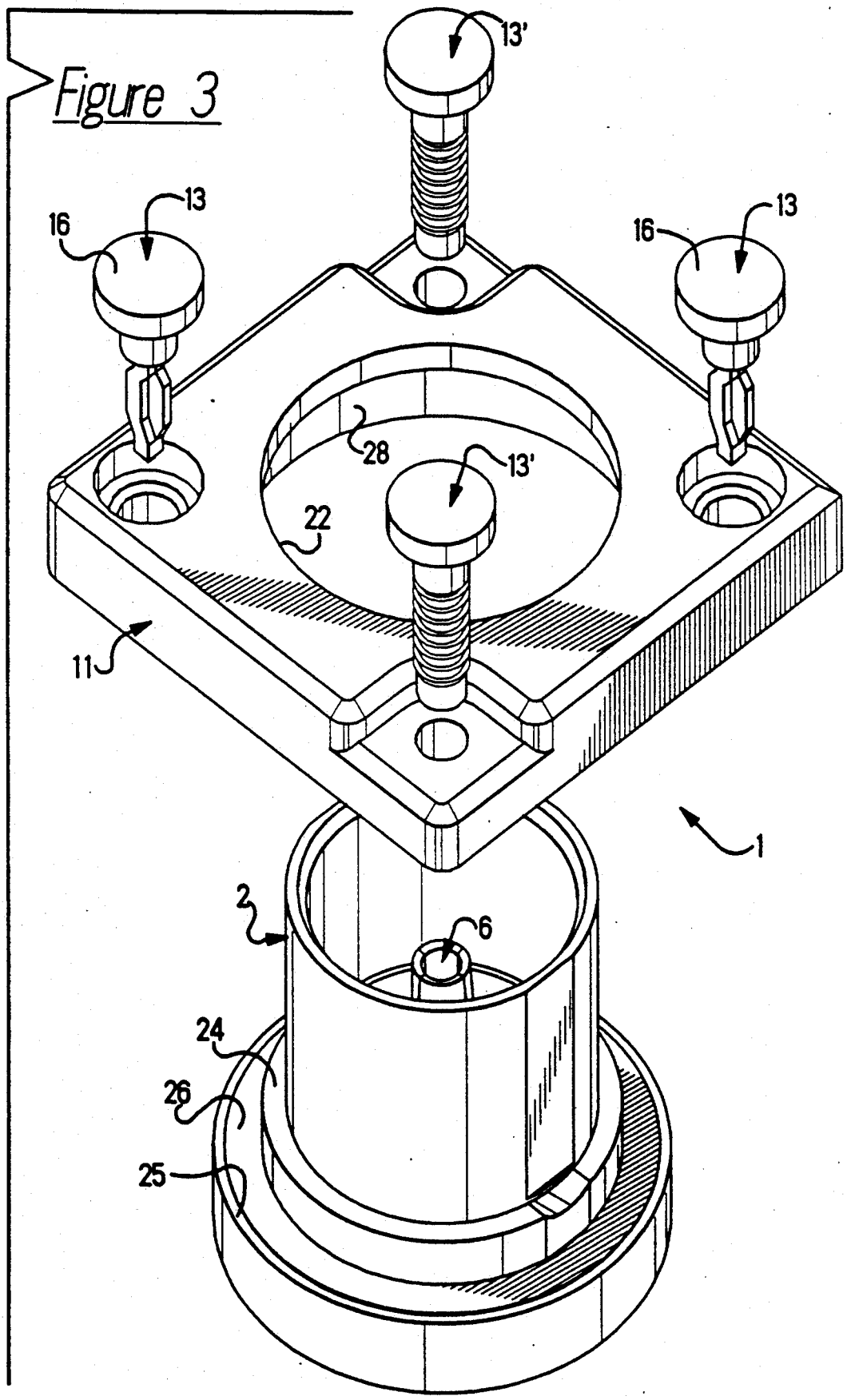
FIG. 3 is a perspective view of the connector shown in FIG. 1 with parts separated from one another.
Figure 4:
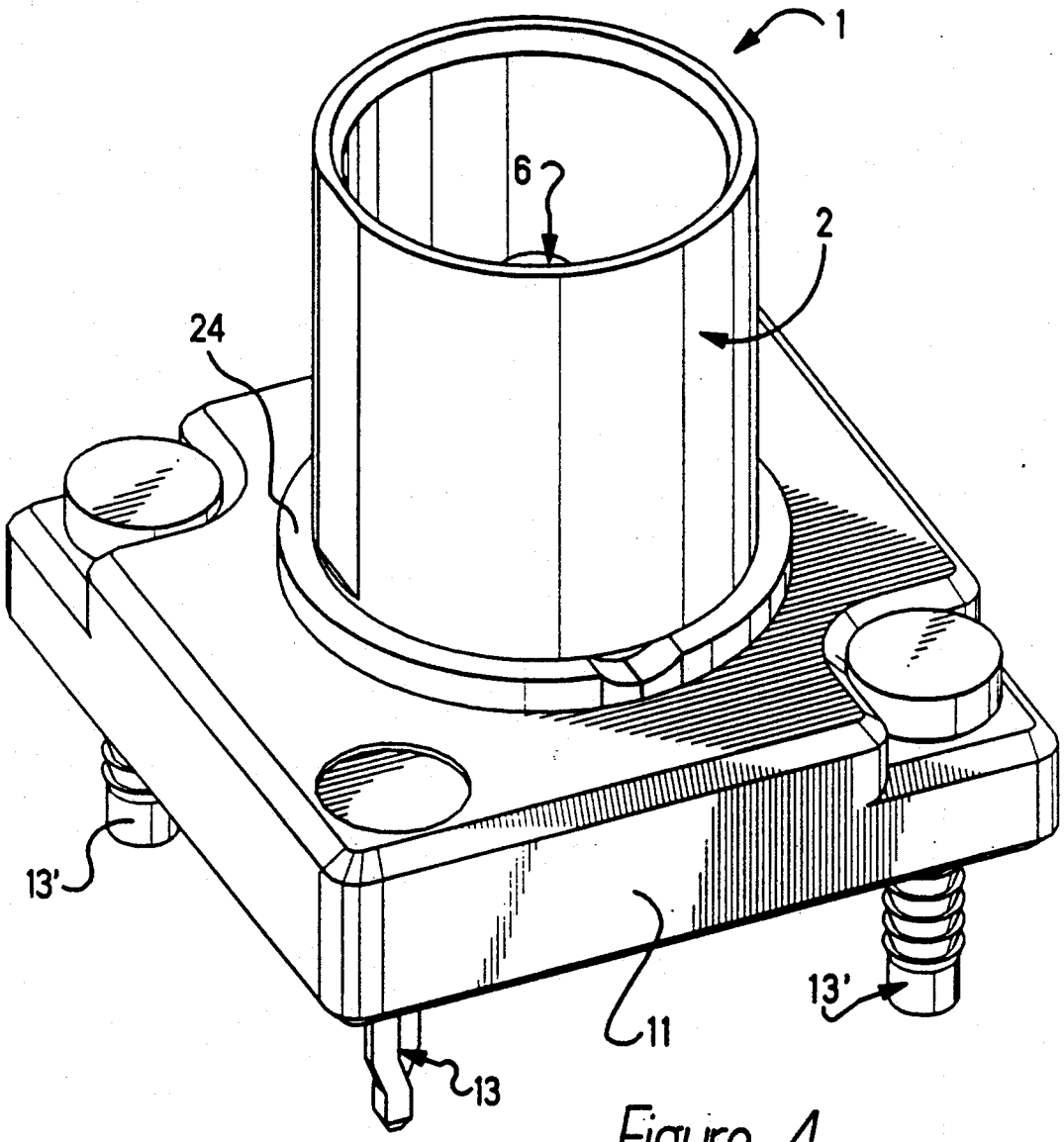
FIG. 4 is a perspective view of the connector shown in FIG. 3 with the parts assembled.
Figure 5:
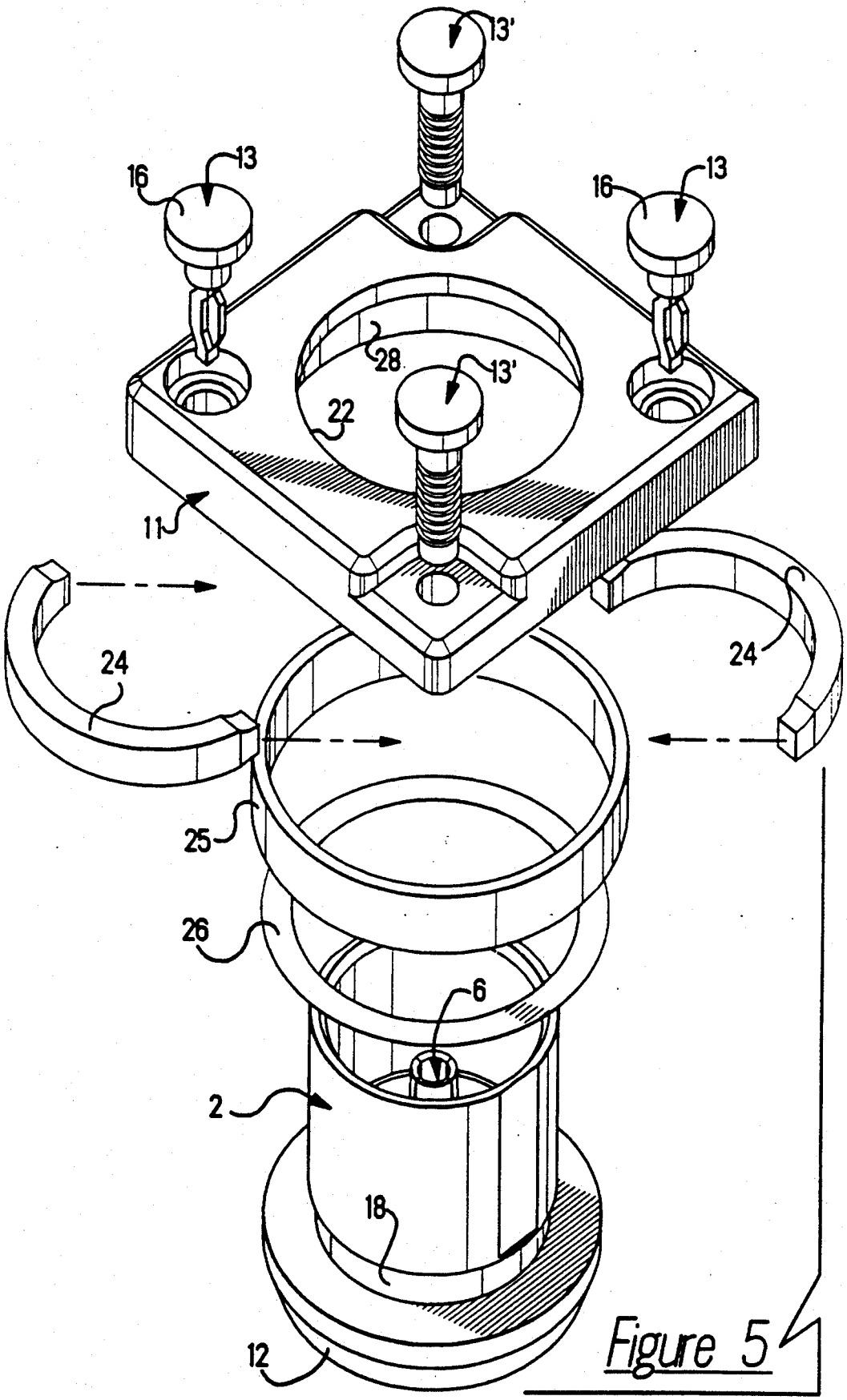
FIG. 5 is a perspective view of the connector shown in FIG. 4.

With reference to FIG. 2, the bottom 12 of the shell 2 has a stepped exterior, having an annular groove 18 recessed in the exterior, an enlarged diameter portion 19 defining an exterior, circular flange 20 next to the groove 18, and a tapered, frustoconical end 21. The base 11 has a stepped interior passage 22 surrounding the stepped exterior of the shell 2. Insulative material 23 in the form of a first ring 24 which can be constructed of two segments butted together, and retained in the groove 18, FIG. 3. The second ring 25 is a separate cylindrical part assembled around and on the bottom 12, or is a part that is molded directly around and on the bottom 12. A semiconductive capicitance element 26 comprising a relatively thin washer of insulative material, such as Barium Titinate, surrounds the shell 2 and is placed against the flange 20. The base 11 is passed over the shell, FIG. 3, until the element 26 registers against an interior transverse surface 27 of the shell that extends transverse to the axis of the coaxial connector 1. An electrical capacitance is established by intimate contact of the element 26 between the shell 2 and the base 11. If a voltage across the shell 2 is induced by, RFI, the voltage will be transmitted across the element 26, through the base 11, through the posts 13 and into a ground plane of a circuit board, not shown, to which the posts 13 are connected. Thereby the contact 6 is advantageously protected from RFI.

To insure intimate contact, the base 11 has a thin rim 28 that is radially inwardly formed toward the frustoconical portion 21 of the shell 2 to assume a frustoconical shape. The ring 25 is also deformed radially to conform to the shape of the portion 21. A clearance surrounds the rim 28 to permit receipt of a forming tool, not shown, against the rim 28. The rim 28 is deformed radially and in a direction axially, due to the frustoconical shape. The rim 28 when deformed axially will urge the shell 2 axially against the element 26, and will urge both of them axially toward the transverse surface 27, clamping the element 26 between the shell 2 and the base 11 and establishing the intimate contact. The element 26 is in a relatively small space or clearance between the shell 2 and the base 11. To insure that the shell 2 is insulated from the base 11, the insulative material of the insulative material 23 fills relatively large, radial spaces or clearances between the shell 2 and the base 11. The insulative material 23 encloses the element 26.

We claim:

1. An electrical connector comprising: a conductive contact connected to a circuit board mounting terminal, an insulative body surrounding the contact, an electrically conductive shell surrounding the insulative body, an electrically conductive base surrounding the shell, a mating portion of the shell projecting forwardly of the base, conductive circuit board mounting posts on the base, and an electrical capacitance element between the shell and the base, thereby establishing capacitive coupling therebetween.

2. An electrical connector as recited in claim 1, wherein, the element surrounds the shell, and the base surrounds the element.

3. An electrical connector as recited in claim 1, wherein, the shell has a stepped diameter, and the base has a stepped passage conforming to the stepped diameter of the shell.

4. An electrical connector as recited in claim 1, wherein, a bottom of the shell is frustoconical, and the base conforms to the frustoconical bottom.

5. An electrical connector as recited in claim 1, wherein, the element comprises, a washer of semiconductive material bridging a relatively narrow space between the shell and the base.

6. An electrical connector as recited in claim 1, wherein, insulative material bridges a relatively wide space between the shell and the base, and the element comprises, a washer of semiconductive material bridging a relatively narrow space between the shell and the base.

7. An electrical connector as recited in claim 1, wherein, the element comprises, a relatively thin semiconductive material in a relatively narrow space between the shell and the base, and relatively thick insulative material separating the shell and the base.

8. An electrical connector as recited in claim 1, wherein, the base includes a deformable rim surrounding the shell at a bottom of the shell, and insulative material bridges between the deformable rim and the shell.

9. An electrical connector as recited in claim 1, wherein the element is enclosed by insulative material between the shell and the base.

10. An electrical connector comprising: a conductive contact connected to a circuit board mounting terminal, an insulative body surrounding the contact, an electrically conductive shell surrounding the insulative body, an electrically conductive base surrounding the shell, conductive circuit board mounting posts on the base, the shell being insulated from the base, and an electrical capacitance element between the shell and the base, thereby establishing capacitive coupling therebetween.

11. An electrical connector as recited in claim 10, wherein, the element is enclosed by insulative material between the shell and the base.

12. An electrical connector as recited in claim 10, comprising: insulative material in relatively wide spaced between the shell and the base.

13. An electrical connector as recited in claim 12, wherein the element is clamped in an axial direction between the shell and the base, and the insulative material is radially between the shell and the base.

14. An electrical connector as recited in claim 10, wherein, the base urges the shell axially against the element.

* * * * *